US006006432A

United States Patent [19]

Cachot

[11] Patent Number: 6,006,432

[45] Date of Patent: Dec. 28, 1999

[54] POCKET KNIFE

[75] Inventor: Maurice Cachot, Delémont, Switzerland

[73] Assignee: Wenger SA, Delemont, Switzerland

[21] Appl. No.: 09/102,120

[22] Filed: Jun. 22, 1998

[30] Foreign Application Priority Data

Jul. 1, 1997 [CH] Switzerland ..... 1584/97

[51] Int. Cl.[6] ..... A24F 13/26

[52] U.S. Cl. ..... 30/112; 30/111; 30/146

[58] Field of Search ..... 30/109, 111, 112, 30/146, 152, 156, 330, 158; 7/118, 158

[56] References Cited

U.S. PATENT DOCUMENTS

| | | | |
|---|---|---|---|
| 1,094,338 | 4/1914 | Leisegang | 30/112 |
| 1,096,274 | 5/1914 | Simsarian | 30/112 |
| 1,107,950 | 8/1914 | Holsen | 30/112 |
| 1,219,203 | 3/1917 | Walker | 30/112 |
| 1,467,661 | 9/1923 | Undy | 7/118 |
| 5,857,268 | 1/1999 | Park | 30/146 |

*Primary Examiner*—Hwei-Slu Payer
*Attorney, Agent, or Firm*—Oliff & Berridge, PLC

[57] ABSTRACT

A multifunctional pocket knife, in particular a Swiss knife, has lateral sides serving as a handle, and including at least one cigar cutter able to pivot or slide in a plane parallel to the inner faces of the lateral sides. The cigar cutter includes two rounded scissor elements pivoting, one with respect to the other, about a first axis pivot. One end of the first element is able to pivot about a second axis pivot enabling the first element to be pulled out of the knife. A spring blade, which can be pulled out, allows the scissor elements to be kept spaced open when they are pulled out of the knife. The spring blade limits the pivoting path of the second element about the second pivot axis. An elastic back blade transmits a constant force to the second scissor element through the agency of the spring blade.

19 Claims, 1 Drawing Sheet

POCKET KNIFE

BACKGROUND OF THE INVENTION

1. Field of the Invention

This invention concerns a multifunctional pocket knife.

2. Description of Related Art

Multifunctional pocket knives of the "Swiss knife" type generally comprise one or more cutting blades and/or a plurality of implements pivoting between the two sides of the knife. The success of these knives stems in particular from the great variety of available implements allowing great versatility and numerous uses in diverse areas of application.

SUMMARY OF THE INVENTION

One object of the present invention is to further extend the range of available implements on the versatile knives of the Swiss knife type and to propose a new type of specialized knife.

This object is attained according to the present invention with a multifunctional pocket knife comprising lateral sides serving as a handle, the inner faces of said lateral sides being substantially parallel, and at least one implement being able to pivot or slide in a plane parallel to said inner faces of the lateral sides wherein one of said implements consists of a cigar cutter.

Cigar cutters as such are of course known. They are most often of the "guillotine" type, i.e. they generally comprise a single blade which moves perpendicular to the cutting line. Cigar cutters of the "scissors" type are also known, i.e. comprising two blades pivoting one with respect to the other about an axis connecting the two blades.

Likewise known already are versatile pocket knives, in particular of the Swiss type, equipped with scissors. The lack of strength of the scissors and the small possible spacing open of the scissor blades make them inadequate for cutting the end of cigars, in particular cigars of large diameter. Cigar smokers wishing to cut their cigars with a Swiss knife, therefore, generally use the large blade of the knife, which is not very practical and can be dangerous.

BRIEF DESCRIPTION OF THE DRAWINGS

These drawbacks are overcome with the knife according to the invention. A preferred embodiment of which will be described by way of example with the aid of the following figures, wherein.

DETAILED DESCRIPTION OF PREFERRED EMBODIMENTS

The knife 1 comprises, in a general way, two lateral sides, most often, covered with plastic, with two inner faces substantially flat and parallel, between which, diverse implements are disposed, which can be pulled out individually by pivoting or sliding in a plane parallel to the inner faces. The lateral sides serve as a handle for the knife. To simplify the drawings, the knife has been represented here with one of the lateral sides 18 removed, and comprising only the cigar cutter implement of the present invention.

Figure 2:
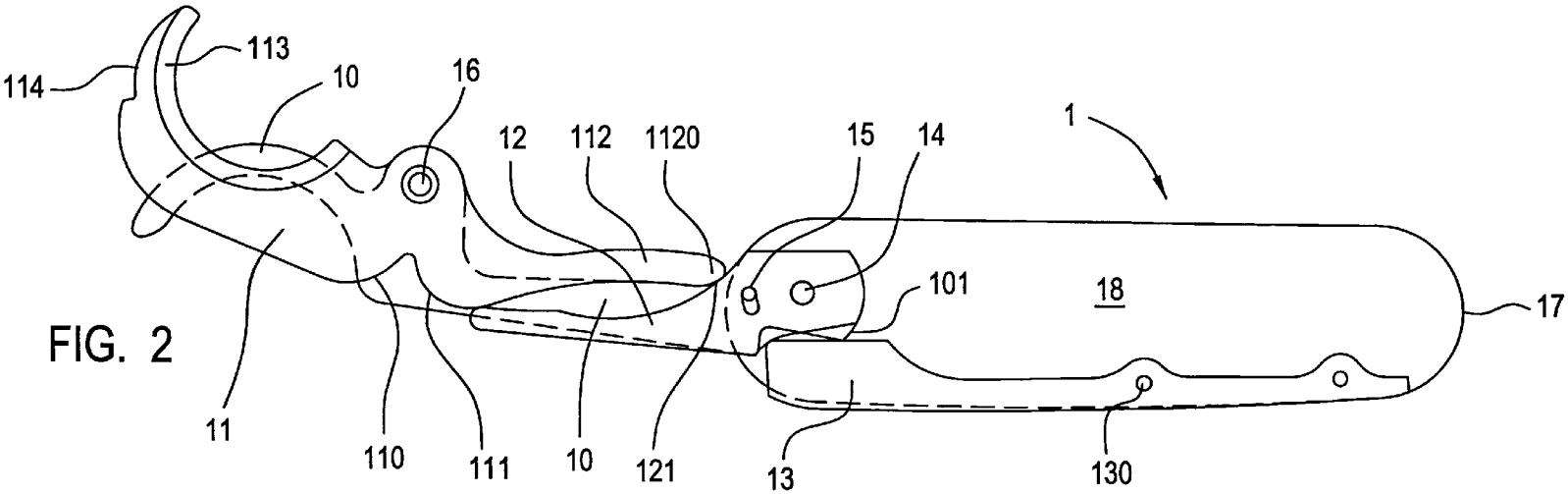
FIG. 2 is a side view of the knife according to the invention showing a cigar cutter with the two scissor elements in the closed position.

The knife is equipped with a cigar cutter of the scissors type, i.e. comprising two scissor elements 10, 11 pivoting one with respect to the other about a first axis pivot 16. The elements 10, 11 each include a curved cutting portion in which the radius of curvature corresponds to at least the maximal radius of common cigars, for example 8 to 19 millimeters, without exceeding dimensions allowing the two blades, when brought together as shown in FIG. 2, to be put away into the body of the knife. One concave edge portion of each cutting portion of the two elements 10, 11 is sharp. Only the sloping edge 113 of the second element 11 is visible in the figures. The convex edge 114 of the cutting portion of the element 11 has the same angle of curvature as the knife end 17 so that this edge becomes at least substantially flush with said end 17 when the cigar cutter is folded back into the knife. The portion 114 thus folds back beyond a pin (not shown) fixing the implements disposed on the side opposite the cigar cutter. This arrangement makes it possible for a cigar cutter to be folded back into the knife, taking up the entire length of the cigar cutter.

Figure 1:
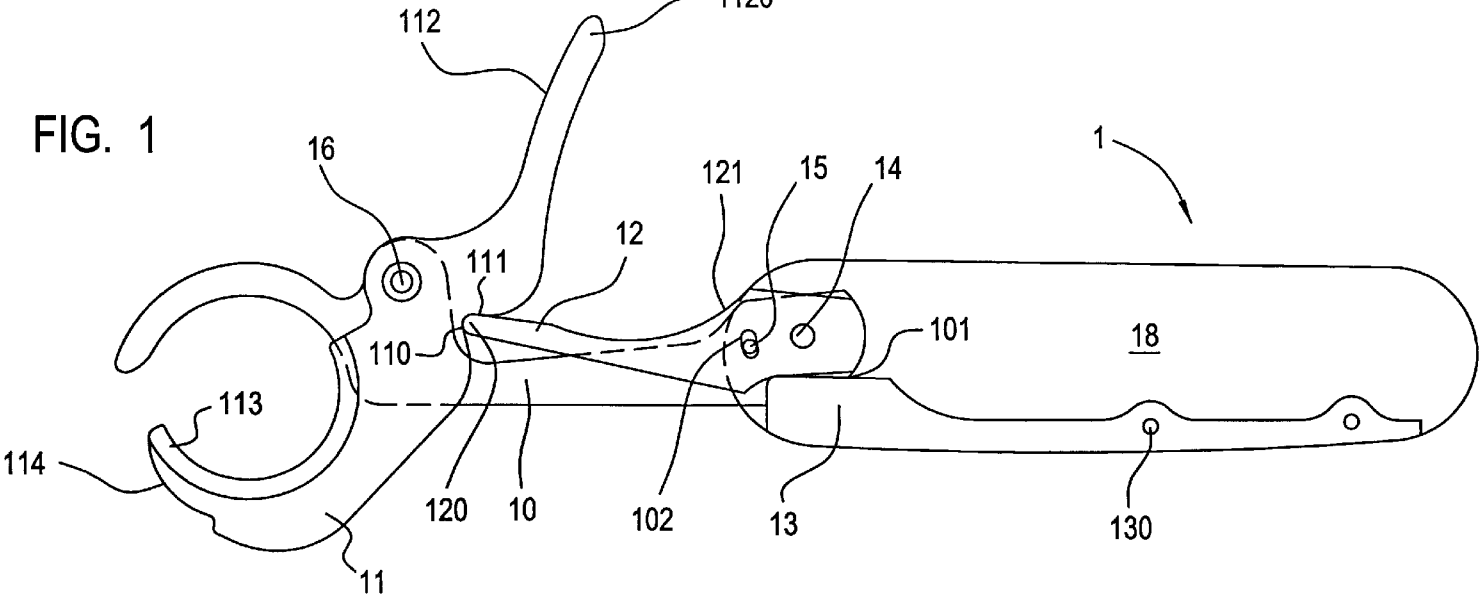
FIG. 1 is a side view of the knife according to the invention showing a cigar cutter with the two scissor elements in spaced open position.

The cigar cutter can be pulled out of the knife 1 by making it pivot about an axis pivot 14 passing through the first scissor element 10. A spring blade 12 is also mounted rotatingly about the same axis pivot 14. The spring blade is disposed in the same plane as the second scissor element 11 so that the cigar cutter assembly, according to the invention, takes up only two blade widths in the knife 1. Means 15, 102 allow the spring blade 12 to be carried along with the first scissor element 10. In the embodiment shown, these means are made up of a lug 15 on the element 10, engaged in an oblong aperture 102 in the spring blade 12. It is clear, however, that this placement can be just as well reversed. The dimensions of the aperture 102 suffice to allow relative rotating movement of the spring blade 12 and of the element 10 between the two positions illustrated in FIGS. 1 and 2.

When the cigar cutter is pulled out of the knife, an elastic back blade 13, articulated about an axis pivot 130, rests against a portion 101 of the first element 10, which the first element pushes back into maximum pulled-out position. The width of the back blade 13 allows it to rest at the same time on the spring blade 12 and to keep it in the intermediate position illustrated in FIG. 1. In this intermediate position, the end 120 of the spring blade 12 comes to rest against resting surfaces 110, 111 of the back edge of the second element 11. The angular position of the second element 11 about the axis pivot 16 is thus determined, when no external force is applied, by the relative placement of the resting surfaces 110, 111, and the spring blade end 120. In particular, the opening of the scissor elements 10, 11 is limited by the resting of the spring blade end 120 of the blade 12 against the resting surface 110 of the second scissor element 11. When no external force is applied, the spring blade 12 keeps the extracted scissor elements 10, 11 spaced sufficiently apart to insert the end of a cigar, but not too far apart to enable the cigar cutter to be operated held in the hand with the thumb pressed on the handle 112. The cigar cutter is thus ready to be used when it is taken out of the knife.

In a remarkable way, means 110 and 120, which limit the spacing of the scissor elements 10, 11, act in the plane of the mobile scissor element 11. This action is unlike common scissors with an opening limited by stop means in another plane, for example, by stop portions on one of the elements limiting the pivoting of the other element. This advantageous arrangement simplifies the manufacture of the scissor elements 10, 11, where, except for the sharp-edged portion, the thickness of the pulled-out portion can be kept constant and limits the overall thickness of the cigar cutter.

The restoring force of the elastic back blade 13 is transmitted to the convex resting surface 111 of the second scissor element 11 through the agency of the spring blade 12. The force to be applied to the scissor end 112 of the element 11 to bring the scissor elements 10, 11 together must consequently be sufficient to make the spring blade 12 pivot and push the back blade 13 downward, as seen in FIG. 2. The pressure exerted by the back blade 13 on the first scissor element 10 is thus decreased so that the first scissor element likewise pivots upward. The extent of displacement of the scissor element 10 is nevertheless limited by the means 15, 102. This arrangement allows the scissor elements 10, 11 to be brought together by exerting a constant force on the end 112.

The pivoting of the two scissor elements beyond the point illustrated in FIG. 2, that is, beyond the point where the two scissor elements 10, 11 are closest together, is prevented by the end 120 of the handle 112 of the second element 11 that comes to stop against a portion 121 of the spring blade 12. It is to be noted, therefore, that the pivot path of the second element 11 about the axis pivot 16 is limited solely by the contacts between the surfaces 120 and 110, or, respectively, 121 and 1120. This advantageous path is owing to the spring blade 12, which transmits a constant force to the element 11 regardless of its angular position.

What is claimed is:

1. A multifunctional pocket knife having lateral sides serving as a handle, the lateral sides including inner faces being substantially parallel, and at least one implement being able to pivot or slide in a plane parallel to said inner faces of the lateral sides, wherein the at least one implement is a cigar cutter, the cigar cutter comprising a first rounded scissor element and a second rounded scissor element, said second rounded scissor element including a back edge with an angle of curvature that is the same as an end of the knife so that said second rounded scissor element can be folded back parallel to said lateral sides with said back edge flush with said knife end.

2. The knife of claim 1, wherein the first and second rounded scissor elements pivot one with respect to the other about a first axis pivot, one end of the first rounded scissor element being able to pivot about a second axis pivot enabling the first rounded scissor element to be pulled out of said knife.

3. The knife of claim 2, wherein said cigar cutter further comprises a spring blade that spaces apart said rounded scissor elements when the rounded scissor elements are pulled out of said knife.

4. The knife of claim 3, wherein said spring blade is disposed in a same plane as the second rounded scissor element and pivots about said second axis pivot.

5. The knife of claim 4, further comprising means for carrying said spring blade along with said first rounded scissor element when said first rounded scissor element pivots about said second axis pivot.

6. The knife of claim 5, further comprising an elastic back blade acting upon said first rounded scissor element to maintain the first rounded scissor element in a position pulled out of said knife and simultaneously acting upon said spring blade so that said spring blade keeps said rounded scissor elements spaced open or said elastic back blade acts upon the first rounded scissor element to maintain the first rounded scissor element in a position retracted into said knife.

7. The knife of claim 6, wherein said second rounded scissor element comprises a resting surface against said spring blade the shape of the resting surface being such that force exerted to close said rounded scissor elements is substantially constant.

8. The knife of claim 3, further comprising an elastic back blade acting upon said first rounded scissor element to maintain the first rounded scissor element in a position pulled out of said knife and simultaneously acting upon said spring blade so that said spring blade keeps said rounded scissor elements spaced open or said elastic back blade acts upon the first rounded scissor element to maintain the first rounded scissor element in a position retracted into said knife.

9. The knife of claim 8, wherein said second rounded scissor element comprises a resting surface against said spring blade the shape of the resting surface being such that force exerted to close said rounded scissor elements is substantially constant.

10. The knife of claim 8, wherein the open spacing of said rounded scissor elements is limited by means acting in the plane of said second rounded scissor element.

11. The knife of claim 10, wherein said means for limiting the open spacing comprises a stop surface provided on said second rounded scissor element and in contact with a portion of said spring blade when said rounded scissor elements are spaced open.

12. The knife of claim 4, further comprising an elastic back blade acting upon said first rounded scissor element to maintain the first rounded scissor element in a position pulled out of said knife and simultaneously acting upon said spring blade so that said spring blade keeps said rounded scissor elements spaced open or said elastic back blade acts upon the first rounded scissor element to maintain the first rounded scissor element in a position retracted into said knife.

13. The knife of claim 12, wherein said second rounded scissor element comprises a resting surface against said spring blade, the shape of the resting surface being such that force exerted to close said rounded scissor elements is substantially constant.

14. A knife comprising:

a plurality of lateral sides, said lateral sides including inner faces, the inner faces of the lateral sides being substantially parallel with each other; and a cigar cutting implement that pivots between a position for storing the implement between the lateral sides of the knife and a position for using the implement, the implement pivoting within a plane parallel to said inner faces of the lateral sides, the cigar cutting, implement comprising a first rounded scissor element and a second rounded scissor element, said second rounded scissor element including a back edge with an angle of curvature that is the same as an end of the knife so that said second rounded scissor element can be folded back parallel to said lateral sides with said back edge flush with said knife end.

15. The knife of claim 14, wherein the first and second rounded scissor elements are coupled together by a first pivot and pivot one with respect to the other about the first pivot, the first rounded scissor element including a first end coupled to the lateral side of the knife by a second pivot, the first rounded scissor element pivoting about the second pivot when the cigar cutting implement is moved from the position for storing to the position for using.

16. The knife of claim 15, wherein said cigar cutting implement further comprises a spring blade disposed in a same plane as the second rounded scissor element and pivots about the second pivot, the spring blade applies a force to the second rounded scissor element to space apart said rounded scissor elements when the cigar cutting implement is in a position for using.

17. The knife of claim 16, further comprising means for moving the spring blade with the first rounded scissor element when said first rounded scissor element pivots about said second pivot.

18. The knife of claim 16, further comprising an elastic back blade that acts in cooperation with the first rounded scissor element to maintain the first rounded scissor element in the position for using and simultaneously acts in cooperation with the spring blade to apply the force that spaces the scissor elements apart, the elastic back blade cooperates with the first rounded scissor element to maintain the position for storing.

19. The knife of claim 18, wherein the second rounded scissor element comprises a resting surface cooperating with the spring blade, the shape of the resting surface being such that force exerted in opposition to the force applied to space apart the rounded scissor elements is substantially constant.

* * * * *